United States Patent [19]

Harato et al.

[11] 3,978,911

[45] Sept. 7, 1976

[54] TILTING CENTRIFUGAL CASTING MACHINE

[75] Inventors: Kazunori Harato; Yoshihiro Sakata; Yutaka Nishimura, all of Kitakyushu, Japan

[73] Assignee: Hitachi Metals, Ltd., Japan

[22] Filed: July 20, 1973

[21] Appl. No.: 381,005

[30] Foreign Application Priority Data

July 31, 1972 Japan ..... 47-75941

[52] U.S. Cl. ..... 164/286; 164/116

[51] Int. Cl.[2] ..... B22D 13/02

[58] Field of Search ..... 164/286–302, 164/175, 114–116, 176, 177, 289; 425/425, 435

[56] References Cited

UNITED STATES PATENTS

| | | | |
|---|---|---|---|
| 1,391,164 | 9/1921 | Barkschat | 425/435 |
| 1,802,107 | 4/1931 | Camerota | 164/176 X |
| 2,344,020 | 3/1944 | Boucher | 164/116 |
| 2,406,860 | 9/1946 | Specht | 164/290 |
| 3,648,763 | 3/1972 | Guenzi | 164/301 |
| 3,703,348 | 11/1972 | Pivar | 425/435 X |
| R17,220 | 2/1929 | Wood | 164/116 |

*Primary Examiner*—Francis S. Husar
*Assistant Examiner*—John S. Brown
*Attorney, Agent, or Firm*—Craig & Antonelli

[57] ABSTRACT

A tilting centrifugal casting machine for producing a compound solid roll by centrifugally casting the outer shell and inner layer into an integral structure. The angle of inclination of the axis of rotation of the mold and the angle defined by the line connecting the center of the mold and the center of the rollers relative to the horizontal are selected to be within the optimum ranges, thereby to obtain a tilting type of centrifugal casting machine with high anti-vibration effect and safety in use, capable of producing a defect-free superior compound solid roll.

6 Claims, 6 Drawing Figures

TILTING CENTRIFUGAL CASTING MACHINE

BACKGROUND OF THE INVENTION

This invention relates to a tilting centrifugal casting machine used for casting compound rolling rolls.

For obtaining a rolling roll having both wear and break resistance, it needs to form a compound roll by integrally joining together a high-hardness shell layer and a high-toughness inner layer, and centrifugal casting is most suitable for producing such compound rolls. There have been known several types of methods for producing compound solid rolls according to such centrifugal casting techniques as shown in the following:

1. A method in which first the shell layer alone is formed by centrifugal casting, then the mold is erected and molten metal for forming the inner layer is poured into the mold to form a solid structure;
2. A method in which parts of the shell layer and partial inner layer are formed by centrifugal casting, then the mold is erected and molten metal for forming the inner layer is poured thereinto to thereby make a solid structure;
3. A vertical centrifugal casting method in which the mold is arranged such that its axis of rotation will be vertical, and then both shell and inner layers are formed by centrifugal casting;
4. A special centrifugal casting method in which the axis of rotation of the mold is arranged horizontal and, after forming the shell layer, said axis of rotation is gradually shifted to its vertical position which successively pouring molten metal for the inner layer to thereby make a solid body; and
5. A tilting centrifugal casting method in which the axis of rotation of the mold is tilted at a certain given angle and both shell and inner layers are formed by centrifugal casting to make a solid structure on the centrifugal casting machine.

However, all of these methods have their own drawbacks and attendant problems. For example, the methods of (1) and (2) necessitates use of a specific solvent or the like and also skilled techniques are required for welding. The method of (3) is unsuited for casting of elongated articles such as rolls, while the method of (4) necessitates enlargement of the equipments proportionally to the increase of roll weight and hence is unsuited for industrial use.

The method of (5) is best of the known centrifugal casting methods. According to this method, the above-said problems accompanying the methods of (1) to (4) are solved. That is, the equipment cost is low and no specific welding techniques are required. Further, the component and structure variation occurring in a range from an outer layer to an inner layer can be freely controlled, allowing reduction of the residual stress, increase of strength at the boundary between the outer and inner layers, and the improvement of anti-spalling property (resistivity against rupture caused by the impact) of the outer layer and of the structure of the inner layer.

In a centrifugal casting machine for producing rolls, large centrifugal force is required for obtaining a sound and particularly segregation-free shell, and for this purpose, the mold must be rotated at high speed. It is, on the other hand, of great importance to minimize vibration of the mold for ensuring safety of the casting machine and for obtaining a roll of good quality. This requirement for high speed rotation and that for minimization of mold vibration are the contradictory matters. Heretofore, many efforts and attempts have been made mainly for achieving improvement of the mold by eliminating its strain or improvement of casting machine by increasing its rigidity or by using rollers having a specific vibration-damping means. However, these are not sufficient to obtain satisfactory vibration damping effect. This problem is serious particularly in the method of (5) where the gross weight of the machine including the mold supplied with the molten metal amounts to 3 to 4 times the roll weight as both shell and inner layer are formed by centrifugal casting to make a solid structure on the centrifugal casting machine.

SUMMARY OF THE INVENTION

The present inventors have pursued investigations and studies on vibration in the mold as well as in the supporting bearings in a tilting centrifugal casting machine where the mold used for casting a heavy-weighted roll is supported by rollers at four points, and, as a result, has discovered that the angle of tilt of the casting machine and the angle made by the line connecting the center of the mold and the center of the rollers relative to the horizontal axis (such angle being hereinafter referred to as support angle) are the most important factors for preventing vibration, and it was also found that minimization of such mold vibration makes it possible to prevent segregation that could cause structural non-uniformity at a part near the surface of the shell layer or lamellar segregation produced in the entire shell layer, to prevent faulty graphite configuration from occurring on the shell layer surface of a grain material or microcracks in the shell layer surface of a chilled material, and to obtain a high-quality roll. This also helps to enhance safety in operation of the machine.

It is thus the object of the present invention to provide a tilt centrifugal casting machine for producing solid rolls, in which said angle of tilt and support angle are set at optimal values to obtain the maximum vibration-damping effect.

DESCRIPTION OF THE PREFERRED EMBODIMENTS

The present invention is now described in detail by way of some preferred embodiments thereof with reference to FIGS. 1 to 6 of the accompanying drawings.

Figure 1:
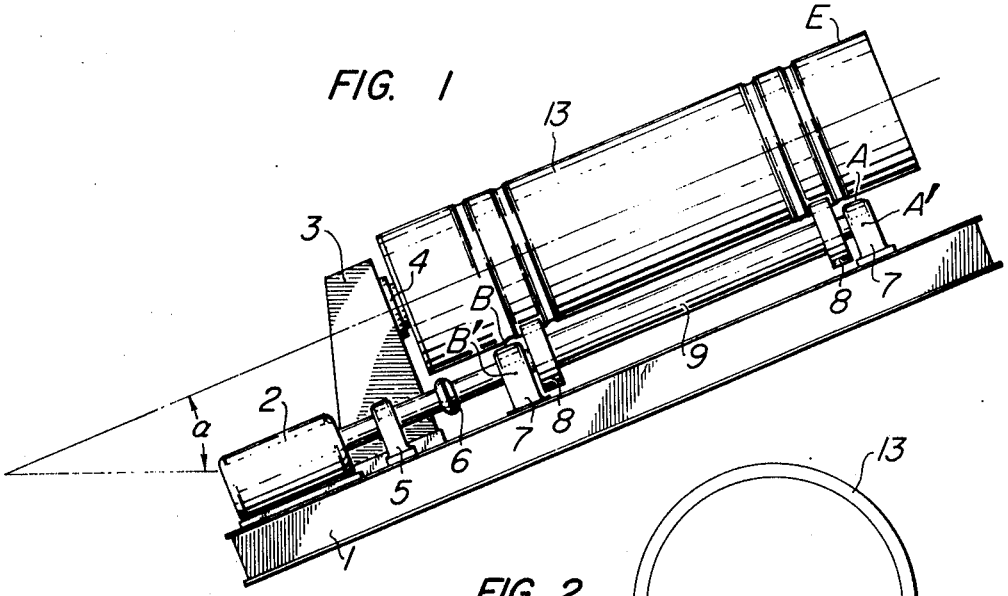
FIG. 1 is a diagrammatic view of a tilting centrifugal casting machine.
Figure 2:
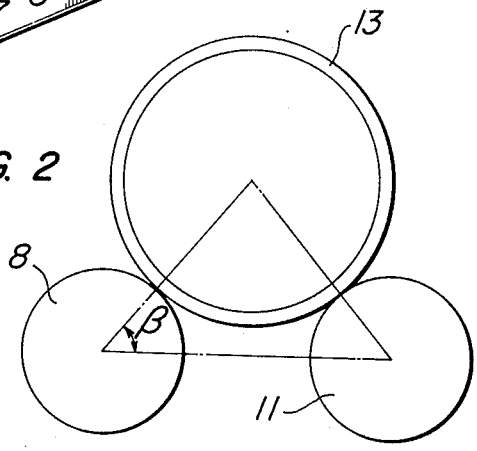
FIG. 2 is a view showing the support angle.
Figure 3:
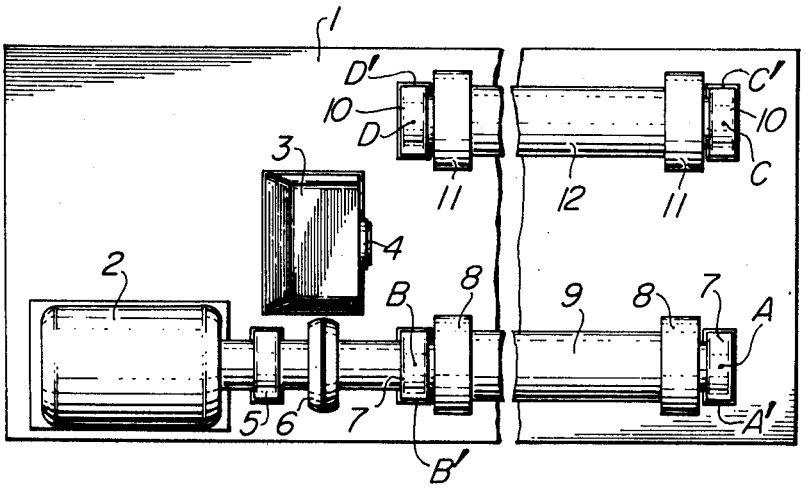
FIG. 3 is a plan view of the casting machine.

Referring first to FIGS. 1 to 3, there is shown a centrifugal casting machine used in the experiments of the present invention. In the figures, $\alpha$ indicates the angle of inclination of the center axis of the mold to the horizontal (such angle being hereinafter referred to as angle of tilt) and $\beta$ indicates the angle made by the line connecting the centers of a pair of rollers and the line connecting the center of the rollers and the center of the mold (such angle being hereinafter referred to as support angle). Said both angles of tilts $\alpha$ and support angle $\beta$ are variable. Arrangement is made such that the angle of tilt $\alpha$ is varied by a hydraulic cylinder (not shown) mounted on the bed of the centrifugal casting machine and the support angle $\beta$ is varied by shifting the mounting position of the driven shaft. These mechanisms are not shown in FIGS. 1 to 3.

The present casting machine comprises essentially a bed 1, a driving motor 2, a carrier 3 supporting the thrust of the mold, a buffer member 4 for absorbing vibration of the mold, an intermediate bearing 5, a coupling 6, driving shaft bearings 7, driving rollers 8, a spindle 9 on the driving side, driven shaft bearings 10, driven rollers 11, a spindle 12 on the driven side, and a mold 13 for producing solid rolls. $\alpha$ indicates the angle of tilt and $\beta$ indicates the support angle. Letters A, B, C and D indicate the mounting positions of the pickups for measuring vibration in the vertical direction relative to the bed in the respective bearings. Similarly, letters A', B', C' and D' indicate the mounting positions of the pickups for measuring vibration in the horizontal direction. Letter E shows the detecting position where the deviation of the mold is optically detected. For this purpose, a phototube is used to measure the displacement at the point E of the mold.

Figure 4:
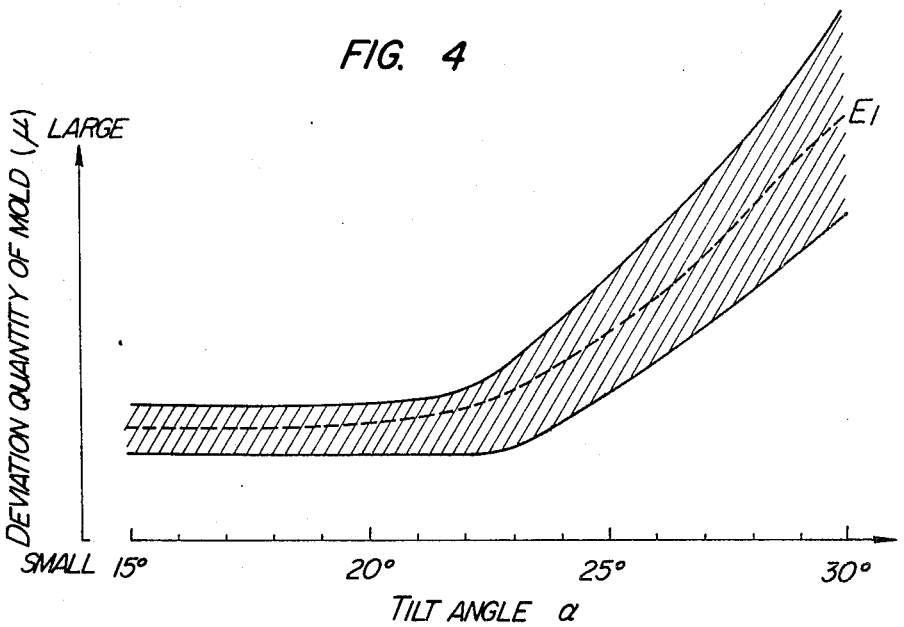
FIG. 4 is a diagram showing the results of measurement of deviation quantity of the upper part of the mold when the mold was rotated by fixing the support angle.
Figure 5:
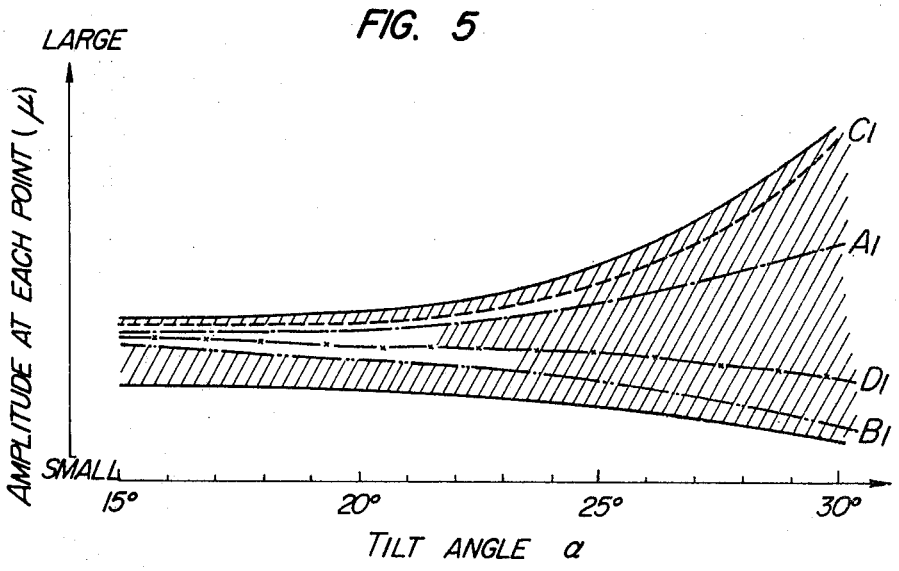
FIG. 5 is a diagram showing the results of measurement of amplitudes in the vertical direction at the respective points of measurement.
Figure 6:
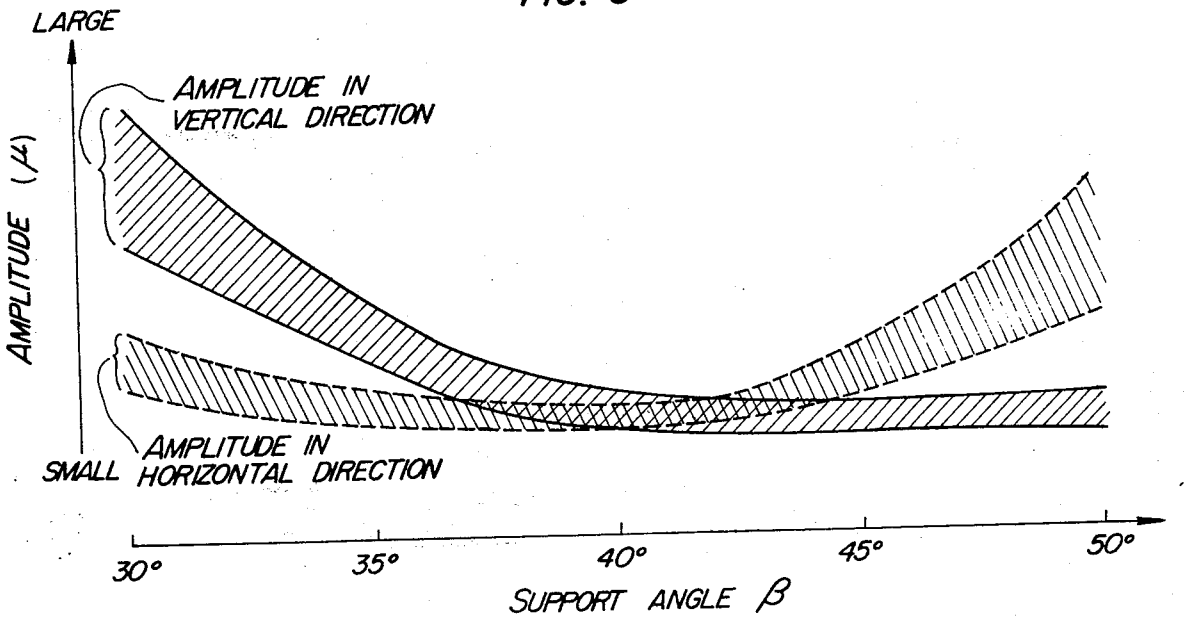
FIG. 6 is a diagram showing the results of deviation measurement in both vertical and horizontal directions when the mold was rotated by fixing the angle of tilt.

FIGS. 4 and 6 show the results of measurement of amplitude as measured when a same mold 13 with the inner diameter of 500 mm$\phi$ was rotated at the rotational frequency of 720 r.p.m. so that the gravitational magnification $G_{NO}$ (ratio of centrifugal force to gravity) will become greater than 140 ($G_{NO}>140$), at the respective spots of measurement A, B, C, D, E and A', B', C', D'. In the centrifugal casting machine, the frequency of vibration agrees substantially with the rotational frequency of the mold, so that, for damping vibration, it needs to sufficiently reduce the amplitude, and in this respect, it is of vital importance to select the angles (both angles of tilt $\alpha$ and support angle $\beta$) that will make the amplitude smallest when said angles are varied successively. FIGS. 4 and 5 show the results of measurement (within the shadowed areas) of amplitude at mold speed (rotational frequency) of 720 r.p.m by variously changing the angle of tilt $\alpha$ while fixing the support angle $\beta$ at 40°. In the figures, letters $A_1$, $B_1$, $C_1$, $D_1$ and $E_1$ show the amplitudes in the vertical direction at the spots A, B, C, D and the amount of deviation of the mold at the spot E, respectively. In the tilting centrifugal casting machine, it needs to confine to minimum the quantity of a feeder head for improving the yield of the molten bath, and for this, it is desirable that the angle of tilt $\alpha$ is enlarged to the maximum. If $\alpha<15°$, the quantity of a feeder head is increased too much, making the machine almost useless for producing solid rolls. On the other hand, if the angle of tilt is enlarged, the mold weight loaded to the driving rollers 8 and driven rollers 11 is varied. That is, as the angle of tilt $\alpha$ is enlarged, the weight loaded to the lower driving roller 8 and driven roller 11 positioned close to the carrier 3 is increased, while the weight loaded to the upper driving roller 8 and driven roller 11 is correspondingly reduced, so that the mold 13 makes a rising-up movement as if it hits said upper driving roller 8 and driven roller 11. This causes an increase of the amplitude at the measuring spots A and C and a sharp increase of the runout of the mold at the measuring spot E. If the angle $\alpha$ exceeds 23°, particularly the rate of increase of runout of the mold becomes excessively high, and it becomes dangerous to rotate the mold at the speed of 720 r.p.m. with gravitational magnification (rate of gravity to centrifugal force) $G_{NO}>140$, making it hardly possible to produce the good rolls, so that the angle of tilt was defined within the range of 15° to 23°. FIG. 6 shows the results of measurements of amplitudes in both vertical and horizontal directions at the measuring spots A, B, C, D and A', B', C', D' as measured when the mold was rotated at speed of 720 r.p.m. by varying the support angle $\beta$ while fixing the angle of tilt $\alpha$ at 20°, with such results of measurements being expressed within the obliquely lined areas. The amplitude in the horizontal direction is about 20 to 40 % smaller than the amplitude in the vertical direction. In FIG. 6, for the sake of simplification, the graduations of amplitudes in both directions are shown overlapped with each other. As will be noted, the amplitude in the vertical direction shows a sharp increase when the support angle $\beta$ is small, while the amplitude in the vertical direction is increased as the support angle $\beta$ is enlarged. The support angle at which the amplitudes in both vertical and horizontal directions become smallest is between 35° and 45°, so that, in the present invention, such support angle was defined within the range of 35° to 45°.

Table 1

| Support angle $\beta$ | 30° | 34° | 37° | 40° | 44° | 47° | 50° |
|---|---|---|---|---|---|---|---|
| Maximum speed attainable (r.p.m.) | 525 | 630 | 790 | 870 | 830 | 670 | 610 |

Table 1 shows the number of revolutions (r.p.m.) of the mold when either the maximum amplitude at the measuring spots A, B, C and D has exceeded 300 $\mu$ or else the maximum amplitude at the measuring spots A', B', C' and D' has exceeded 100 $\mu$, with the angle of tilt $\alpha$ being fixed at 20°. When the maximum amplitude in the vertical direction exceeds 300 $\mu$ or when the maximum amplitude in the horizontal direction exceeds 100 $\mu$, the vibration of the mold becomes very severe to make it hardly possible to further increase the number of revolutions. The number of revolutions at this moment is the maximum speed attainable. For producing the solid rolls, there is required a tilting centrifugal casting machine which is capable of constantly and stably producing high speed revolutions with gravitational magnification $G_{NO}$ of not less than 140 ($G_{NO} \geqq 140$) using rolls of about 500 mm$\phi$ in drum diameter, and in such case, the most effective support angle $\beta$ is around 40°.

Table 2

| Angle of Tilt $\alpha$ | Support Angle $\beta$ | | | | | | |
|---|---|---|---|---|---|---|---|
| | 30° | 34° | 37° | 40° | 44° | 47° | 50° |
| 15° | 595 | 695 | 830 | 865 | 820 | 705 | 680 |
| 18° | 530 | 630 | 780 | 845 | 805 | 680 | 650 |
| 20° | 500 | 610 | 780 | 850 | 810 | 650 | 630 |
| 23° | 510 | 650 | 750 | 840 | 810 | 660 | 620 |
| 25° | 480 | 600 | 680 | 700 | 700 | 620 | 605 |
| 28° | 400 | 450 | 520 | 535 | 530 | 535 | 525 |
| 30° | 410 | 470 | 500 | 515 | 510 | 515 | 505 |
| 35° | 380 | 410 | 480 | 465 | 455 | 460 | 450 |

Table 2 above shows the number of revolutions (r.p.m.) of the mold attained under the same vibration above said when using a different mold with various combinations of angle of tilt $\alpha$ and support angle $\beta$. Vibration of the mold becomes more salient with change of the combinations of said both angles $\alpha$ and $\beta$, and it becomes necessary to define the angle of tilt $\alpha$ within the range of 15° to 23° and the support angle $\beta$ within the range of 35° to 45° for obtaining a sufficient high speed revolution within the scope of safety. Calculating from the above-said molten bath yield and other factors, it is found that the angles that can reduce the mold vibration are within the range of from 17 to 22° for the angle of tilt and from 38° to 42° for the support angle, and the angles that can minimize such mold vibration are within the range of from 20° to 22° for the angle of tilt and from 40° to 42° for the support angle.

As described above, the tilting centrifugal casting machine according to the present invention can reduce vibration of the mold to minimum to allow prevention of segregation or cracks in the shell of the solid rolls or other casting defects that would be caused by vibration of the mold. Thus, the present invention realizes production of solid rolls with safety and low equipment cost, contributing greatly to the industries concerned.

What is claimed is:

1. A tilting centrifugal casting machine for casting a solid composite roll, the casting machine comprising: a support means, a mold means for receiving the material to be cast into a solid composite roll, means for supporting the mold means on said support means including a pair of spaced parallel shaft means disposed beneath said mold means and extending parallel to the longitudinal axis of said mold means, means for rotatably mounting each of said shaft means on said support means, a pair of spaced roller means provided on each of said shaft means and engaging said mold means, drive means for driving one of said spaced shaft means, a carrier means disposed on said support means for absorbing the thrust of said mold means, the angle of tilt of the casting machine is fixed to a predetermined value selected within the range of from 15° to 23° and an angle made by a line connecting the center of said mold means and the center of said roller means relative to a horizontal plane is fixed to a predetermined value selected within the range of from 35° to 45°, and wherein said mold means includes a first end and a second end, said first end being closer than said second end to the apex of the angle of tilt, said carrier means is provided on said support means at said first end of said mold means, and wherein a buffer means is provided on said carrier means for absorbing vibrations of said mold means, said buffer means being interposed between said carrier means and said first end of said mold means.

2. A casting machine according to claim 1, wherein the roller means on one of said shaft means are disposed in substantial alignment with the roller means on the other of said shaft means, said mold means being provided with means for accommodating said roller means, and wherein said shaft means, said roller means and said carrier means provide the sole support for the mold means on said support means.

3. A tilting centrifugal casting machine for casting a solid composite roll, the casting machine comprising a support means, a mold means for receiving the material to be cast into a solid composite roll, means for supporting the mold means on said support means including a pair of spaced parallel shaft means disposed beneath said mold means and extending parallel to the longitudinal axis of said mold means, means for rotatably mounting each of said shaft means on said support means, a pair of spaced roller means provided on each of said shaft means and engaging said mold means, drive means for driving one of said spaced shaft means, a carrier means disposed on said support means for absorbing the thrust of said mold means, the angle of tilt of said casting machine is fixed to a predetermined value selected within the range of 17° to 22° and an angle made by a line connecting the center of said mold means and the center of said roller means relative to a horizontal plane is fixed to a predetermined value selected within the range of 38° to 42°, and wherein said mold means includes a first end and a second end, said first end being closer than said second end to the apex of the angle of tilt, said carrier means is provided on said support means at said first end of said mold means, and wherein a buffer means is provided on said carrier means for absorbing vibrations of said mold means, said buffer means being interposed between said carrier means and said first end of said mold means.

4. A casting machine according to claim 3, wherein the roller means on one of said shaft means are disposed in substantial alignment with the roller means on the other of said shaft means, said mold means being provided with means for accommodating said roller means, and wherein said shaft means, said roller means and said carrier means provide the only support for said mold means on said support means.

5. A tilting centrifugal casting machine for casting a solid composite roll, the casting machine comprising: a support means, a mold means for receiving the material to be cast into a solid composite roll, means for supporting the mold means on said support means including a pair of spaced parallel shaft means disposed beneath said mold means and extending parallel to the longitudinal axis of said mold means, means for rotatably mounting each of said shaft means on said support means, a pair of spaced roller means provided on each of said shaft means and engaging said mold means, drive means for driving one of said spaced shaft means, a carrier means disposed on said support means for absorbing the thrust of said mold means, the angle of tilt of the casting machine is fixed to a predetermined value selected within the range of 20° to 22° and an angle made by a line connecting the center of said mold means and the center of said roller means relative to a horizontal plane is fixed to a predetermined value selected within the range of from 40° to 42°, and wherein said mold means includes a first end and a second end, said first end being closer than said second end to the apex of the angle of tilt, said carrier means is provided on said support means at said first end of said mold means, and wherein a buffer means is provided on said carrier means for absorbing vibrations of said mold means, said buffer means being interposed between said carrier means and the front end of said mold means.

6. A casting machine according to claim 5, wherein the roller means on one of said shaft means are disposed in substantial alignment with the roller means on the other of said shaft means, said mold means being provided with means for accommodating said roller means, and wherein said shaft means, said roller means and said carrier means provide the only support for said mold means on said support means.

* * * * *